United States Patent [19]

Takamatsu et al.

[11] Patent Number: 4,875,077

[45] Date of Patent: Oct. 17, 1989

[54] IMAGE-FORMING MACHINE

[75] Inventors: Junichi Takamatsu, Sennan; Kazunori Akiyama, Suita, both of Japan

[73] Assignee: Mita Industrial Co., Ltd, Tokyo, Japan

[21] Appl. No.: 284,734

[22] Filed: Dec. 15, 1988

Related U.S. Application Data

[62] Division of Ser. No. 50,438, May 18, 1987, Pat. No. 4,829,334.

[30] Foreign Application Priority Data

| | | | |
|---|---|---|---|
| May 28, 1986 | [JP] | Japan | 61-79541[U] |
| Oct. 13, 1986 | [JP] | Japan | 61-242597 |
| Nov. 28, 1986 | [JP] | Japan | 61-281698 |

[51] Int. Cl.[4] ..... G03G 15/00

[52] U.S. Cl. ..... 355/212; 355/271

[58] Field of Search ..... 355/3 R, 3 BE, 3 DR, 355/3 TR, 16, 211, 212, 271

[56] References Cited

U.S. PATENT DOCUMENTS

| | | | |
|---|---|---|---|
| 4,577,953 | 3/1986 | Narukawa | 355/3 BE |
| 4,627,701 | 12/1986 | Onoda et al. | 355/3 CH |
| 4,668,072 | 5/1987 | Yasuda | 355/3 BE X |
| 4,758,486 | 7/1988 | Yamazaki et al. | 355/3 BE X |

FOREIGN PATENT DOCUMENTS

| | | | |
|---|---|---|---|
| 57-210361 | 12/1982 | Japan | 355/3 R |

*Primary Examiner*—Arthur T. Grimley
*Assistant Examiner*—J. Pendergrass
*Attorney, Agent, or Firm*—Antonelli, Terry & Wands

[57] ABSTRACT

An image-forming machine comprising a main body of the machine and an image bearing member disposed within the main body and adapted to form an image on a electrophotographic material disposed of the surface of the image bearing member. According to a first aspect, the main body of the image-forming machine includes a lower supporting frame and an upper supporting frame mounted on the lower supporting frame for free pivotable movement between an open position and a closed position, and a cover member mounted on the upper supporting frame, in which when the upper supporting frame is held at the open position, the cover member covers part of the image bearing member. According to a second aspect, an image-forming area and a non-image-forming area exist on the surface of the image bearing member, and when an image-forming step is over, the non-image-forming are is positioned at a transfer opening formed for image transfer. According to a third aspect, a transfer zone in which to transfer the image to a sheet material and a peeling zone in which to peel the sheet material from the image bearing member are kept in a predetermined relationship so as to ensure accurate peeling of the sheet material.

6 Claims, 10 Drawing Sheets

FIG. 12-A
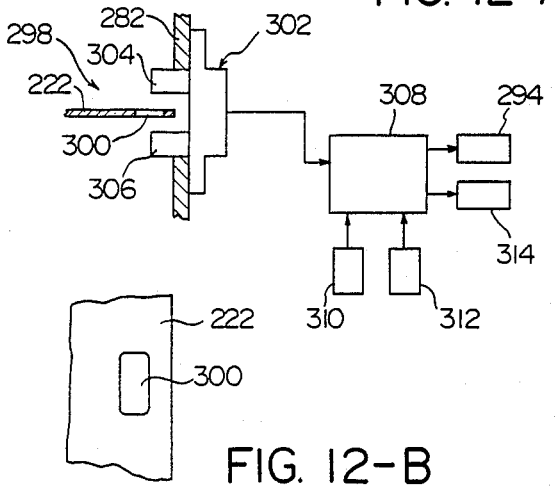
FIG. 12-B
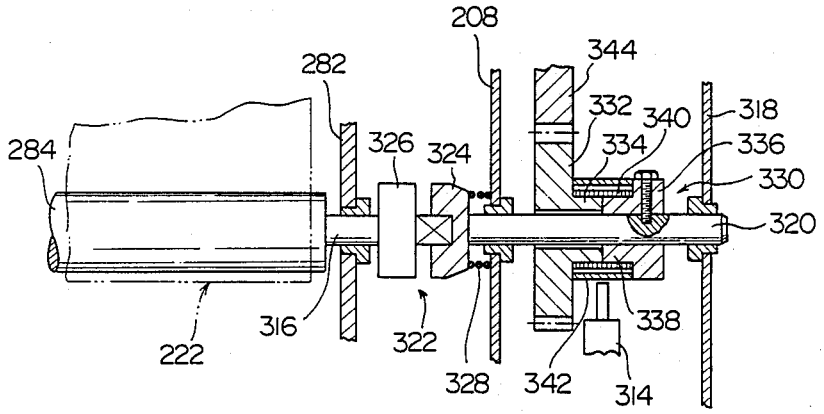
FIG. 13

IMAGE-FORMING MACHINE

This is a division of U.S. patent application Ser. No. 050,438, filed May 18, 1987, now U.S. Pat. No. 4,829,334.

FIELD OF THE INVENTION

This invention relates to an image-forming machine such as an electrostatic copying machine.

DESCRIPTION OF THE PRIOR ART

It is well known to those skilled in the art that image-forming machines such as an electrostatic copying machine or an electrostatic printing machine of the type adapted to form a latent electrostatic image on an electrostatic photographic material and then developing the latent electrostatic image to a toner image have come into widespread commercial acceptance.

One type of the electrostatic copying machine as one example of such an image-forming machine includes a lower supporting frame, an upper supporting frame mounted on the lower supporting frame for free pivotable movement between an open position and a closed position around a central axis of pivoting extending in the front-rear direction, and an image bearing member such as a rotating drum having an electrostatic photographic material on its surface and mounted on the upper supporting frame. In this electrostatic copying machine, when the upper supporting frame is held at the open position, at least a considerable portion of a paper conveying passage is opened, and a copying paper can be easily taken out from it in the event of paper jamming. When the upper supporting frame is at the open position, the lower part of the image bearing member is exposed to outside between the lower supporting frame and the upper supporting frame at the open position. It is likely that the operator's hand or the like will touch the electrophotographic material on the surface of the image bearing member and injure it while the operator is disposing of the jamming paper. To remove this inconvenience, there was proposed an electrostatic copying machine further including a cover member which is free to move between a covering position at which it covers part of the image bearing member and an open position at which the aforesaid part of the image bearing member is opened to view. When the upper supporting frame is held at the open position in this improved electrostatic copying machine, the cover member is held at the covering position, and the electrophotographic material can be prevented from being injured. Since, however, this improved electrostatic copying machine is of such a structure that the cover member moves in substantially the same direction as the moving direction of the image bearing member and is thus brought to the open position from the covering position, it is comparatively difficult to remove a copying paper sheet which has wrapped about the surface of the image bearing member.

Another type of the electrostatic copying machine includes a main body of copying machine and a process unit detachably mounted on the main body, in which the process unit comprises a process unit frame and an image bearing member mounted on the process unit frame. By removing the process unit from the main body in such a type of electrostatic copying machine, maintenance and inspection of the process unit, replacing the image bearing member having an electrostatic photographic material, and color changing in the case of monocolor copying can be carried out easily and rapidly. However, since a transfer opening exists in the process unit frame, the operator's hand or the like is likely to touch the electrophotographic material through the transfer opening and injure it at the time of mounting and detaching the process unit.

Still another type of the electrostatic copying machine comprises a rotating drum having an electrostatic photographic material on its surface and a diameter of as small as 35 mm or less as the image bearing member. As disclosed, for example, in Japanese Laid-Open Patent Publication No. 126571/1984, since the rotating drum in this type of electrostatic copying machine has a small diameter, separation of a sheet material from the rotating drum after transfer is facilitated by the stiffness and weight of the sheet material itself. Hence, a small-sized inexpensive charge eliminating device can be used instead of a peeling corona discharge device or the like as means for separating the sheet material from the rotating drum. However, if the sheet material has low stiffness or has a tendency to curve upwardly toward its front end, it tends to advance while electrostatically adhering to the peripheral surface of the rotating drum without departing from it downwardly. Consequently, the sheet material is likely to wrap around the rotating drum.

SUMMARY OF THE INVENTION

An object of this invention is to provide an excellent image-forming machine in which by effectively utilizing a non-image-forming area on, the surface of an image bearing member, injuring of a electrophotographic disposed on the surface of the image bearing member can be accurately prevented by a relatively simple structure.

Other objects of this invention along with its features will become apparent from the following description.

BRIEF DESCRIPTION OF THE DRAWING

FIG. 12-A is a sectional view showing a position detecting means and its vicinity in the electrostatic copying machine shown in FIG. 10;

FIG. 12-B is a top plan view showing part of an image bearing member in the electrostatic copying machine shown in FIG. 10: and FIG. 13 is a sectional view showing part of a driving system for the image bearing member in the electrostatic copying machine shown in FIG. 10.

DETAILED DESCRIPTION OF PREFERRED EMBODIMENTS

The present invention will be described in detail below with reference to the accompanying drawings. The following description is directed to an electrostatic copying machine as one example of the image-forming machine. It should be understood however that the present invention is not limited to it, but can equally be applied to other image-forming machines such as an electrostatic printing machine.

Outline of the Electrostatic Copying Machine as a First Embodiment

With reference to FIGS. 1 to 5, a first embodiment of the electrostatic copying apparatus as one example of the image-forming machine in accordance with this invention will be described.

Figure 1:
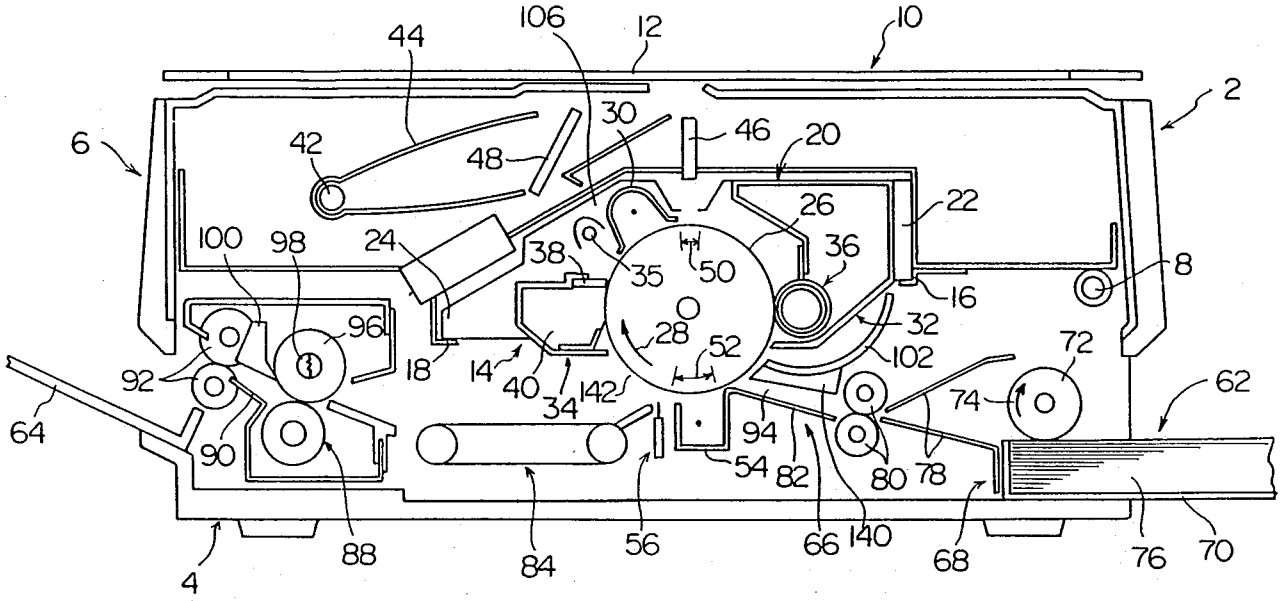
FIG. 1 is a sectional view showing in a simplified manner a first embodiment of an electrostatic copying machine as one example of an image-forming machine constructed in accordance with this invention.

With reference to FIG. 1, the illustrated electrostatic copying machine has a nearly parallelepipedal housing shown generally at 2. The housing 2 is defined by a lower supporting frame 4 and an upper supporting frame 6. The upper supporting frame 6 is pivotably linked at the lower part of its right end portion to the lower supporting frame 4 via a shaft 8 (constituting a central axis of pivoting) extending in the front-rear direction (a direction perpendicular to the sheet surface in FIG. 1). The upper supporting frame 6 is capable of pivoting between a closed position shown in FIGS. 1 and 2 and an open position shown in FIGS. 4 and 5.

A document placing means 10 is mounted on the upper surface of the housing 2, more specifically the upper surface of the upper supporting frame 6, so as to reciprocate to right and left. The document placing means 10 comprises a transparent plate 12 on which to place a document to be copied and an openable and closable document cover (not shown) for covering the transparent plate 12 and the document on it.

A process unit shown generally at 14 and positioned nearly centrally in the housing 2 is detachably mounted on the upper supporting frame 6. A pair of supporting rails 16 and 18 spaced from each other in the left-right direction and extending in a direction perpendicular to the sheet surface are fixed to the upper supporting frame 6. The process unit 14 has a process unit frame 20, and support portions 22 and 24 extending in a direction perpendicular to the sheet surface are provided at left and right end portions of the unit frame 20. The process unit 14 is mounted on, and detached from, the upper supporting frame 6 by positioning the support portions 22 and 24 of the unit frame 20 on the supporting rails 16 and 18 and sliding the unit frame 20 in a direction perpendicular to the sheet surface. A rotating drum 26 as an image bearing member is rotatably mounted nearly centrally on the unit frame 20. A suitable electrostatic photographic material is disposed on the peripheral surface of the rotating drum 26. Further mounted on the unit frame 20 are a charging corona discharge device 30, a developing device shown generally at 32, a cleaning device shown generally at 34 and a charge eliminating lamp 35 in this order around the rotating drum 26 to be rotated in the direction shown by an arrow 28 as viewed in the rotating direction of the rotating drum 26. The developing device 32 is disposed in one side portion (right portion) of the unit frame 20, and the cleaning device 34 and the eliminating lamp 35, in the other side portion (left portion) of the unit frame 20. The developing device 32 has a magnetic brush mechanism 36 for applying a developer to the peripheral surface of the rotating drum 26. The cleaning device 34 has an elastic blade 38 acting on the peripheral surface of the rotating drum 26 and a toner recovering chamber 40. The process unit 14 will be further described hereinafter.

The upper supporting frame 6 has further mounted thereon an illuminating lamp 42, a reflecting plate 44 and an optical system 46 positioned above the process unit 14. The optical system 46 is constructed of a number of vertically extending elongate optical elements (for example, rod-like lenses sold under the trade name "Selfoc Microlens" by Nippon Sheet Glass Co., Ltd.). A filter member 48 such as a heat absorbing filter is provided at an opening formed in the reflecting plate 44. Accordingly, the light from the illuminating lamp is projected through the transparent plate 12 upon the document placed on it. The light reflected from the document is projected on the peripheral surface of the rotating drum 26 in an exposure zone 50 through the optical system 46 and an exposure opening formed in the upper wall of the unit frame 20. To protect the rotating drum 26 accurately, it is preferred to cover the exposure opening by providing a protective glass such as a transparent glass over it.

Nearly at the center of the lower supporting frame 4, there are provided a transfer corona discharge device 54 which faces the peripheral surface of the rotating drum 26 in a transfer zone 52, and a peeling charge eliminating means 56 positioned adjacent to, and downstream of, the transfer corona discharge device 54.

A copying paper feed means shown generally at 62 is disposed in the right end portion of the lower supporting frame 4, and a copying paper receiving tray 64, in the left end portion of the lower supporting frame 4. Between the copying paper feed means 62 and the copying paper receiving tray 64 is disposed a copying paper conveying system shown generally at 66 for conveying copying paper as a sheet material through the transfer zone 52. The paper feed means 62 has a cassette receiving section 68 and a paper cassette 70 loaded detachably in the cassette-receiving section 68, and a delivery roller 72 is disposed above the cassette-receiving section 68. Thus, when the delivery roller 72 is rotated in the direction shown by an arrow 74, the topmost paper in a copying paper layer 76 in the cassette 70 is delivered by the action of the delivery roller 72, and fed to the paper conveying system 66 after advancing between a pair of guide plates 78. The copying paper conveying system 66 includes a pair of conveying rollers 80, a lower guide plate 82, a conveying belt mechanism 84, a heat fixing roller pair 88, a lower guide plate 90 and a pair of discharge rollers 92. These constituent elements define a copying paper conveying passage 94 for conducting the paper fed from the paper feed means 62 to the paper receiving tray 64. A suitable heating means 98 is disposed within an upper heating roller 96 in the heat fixing roller pair 88. A peeling member 100 for preventing wrapping of paper is annexed to the upper heating roller 96.

In the electrostatic copying machine described above, the charging corona discharge device 30 substantially uniformly charges the electrophotographic material on the rotating drum 26 to a specific polarity while the rotating drum 26 is rotated in the direction of arrow 28. Then, in the exposure zone 50, an image of the document of the transparent plate 121 is projected onto the electrophotographic material to form a latent electrostatic image corresponding to the image of the document on the electrophotographic material. At the time of scanning and exposing the document, the document placing means 10 is moved from left to right in FIG. 1. The electrostatic latent image on the electrophotographic material is then developed to a toner image by the developing device 32. A copying paper sheet fed from the paper feed means 62 and conveyed by the paper conveying system 66 comes into intimate contact with the peripheral surface of the rotating drum 26, and by the action of the transfer corona discharge device 54, the toner image of the electrophotographic material is transferred to the copying paper. Thereafter, the paper is peeled from the rotating drum 26 by the action of the charge eliminating means 56. The paper is then conveyed through the heat fixing roller pair 88 and during this time, the toner image on the paper is fixed by heat. In the meantime, the rotating drum 26 continues to rotate, and the toner remaining on the electrophotographic material after transfer is removed by the action of the elastic blade 38 of the cleaning device 34. Furthermore, the remaining charge on the electrophotographic material after transfer is erased by the action of the charge eliminating lamp 35. The removed toner is collected in the toner recovering chamber 44.

Structure of Process Unit and Elements Related Thereto

Now with reference mainly to FIGS. 2 and 3, the process unit 14 and elements related to it in the first embodiment will be described in detail.

The process unit 14 includes a cover member 102 in relation to the fact that the upper supporting frame 6 is free to move between the open position and the closed position. The cover member 102 is formed of a plate-like member having a nearly arcuate vertical sectional surface and may be made from a synthetic resin. With reference mainly to FIG. 3, the process unit frame 20 mounted detachably on the upper supporting frame 6 has a front wall 104 (FIGS. 2 and 3) and a rear wall 106 (FIG. 1) spaced from each other in the front-rear direction, and shaft portions 108 and 110 of the rotating drum 26 are rotatably supported by the front and rear walls 104 and 106. The shaft portion 108 projects forwardly (to the left bottom in FIG. 3) through the front wall 104, and an oscillating arm 112 is pivotably mounted on the forwardly projecting end portion of the shaft portion 108. The other shaft portion 110 projects rearwardly (to the right top in FIG. 3) through the rear wall 106, and an oscillating arm 114 is pivotably mounted on this rearwardly projecting end portion. The one end portion in the arcuate direction (the left bottom corner portion of the cover member 102 in FIG. 3) at one end in the longitudinal direction of the cover member 102 is pivotably connected to the front end portion of oscillating arm 112 through a pin member 116, and the one end portion in the arcuate direction (the left top corner portion of the cover member 102 in FIG. 3) of the cover member 102 at the other end in the longitudinal direction is pivotably connected to the front end portion of the oscillating arm 114 via a pin member (not shown). A shaft member 118 extending substantially parallel to the axis of 35 the rotating drum 26 is disposed in the right portion of the rotating drum 26 is disposed in the right portion of the unit frame 20. The shaft member 118 is mounted rotatably on the front wall 104 and the rear wall 106. One end portion (the front end portion) of the shaft member 118 projects forwardly through the front wall 104, and a revolving arm 120 is fixed to this forwardly projecting end portion by a bolt or the like. An actuating lever 122 is fixed by a bolt or the like to the forwardly projecting end of the shaft 118 at a position further forwardly of the site of mounting the revolving arm 120 (see FIG. 2 also). The other end portion (the rear end portion) of the shaft member 118 projects rearwardly through the rear wall 106, and a revolving arm 124 is fixed to the rearwardly projecting end portion of the shaft member 118 by means of a bolt or the like. The other end portion in the arcuate direction of the cover member 102 at one end in the longitudinal direction (the right bottom corner portion of the cover member 102 in FIG. 3) is pivotably connected to the forward end portion of the revolving arm 120 via a pin member 126. Likewise, the other end portion in the arcuate direction of the cover member 102 at the other end in the longitudinal direction (the right top corner portion of the cover member 102 in FIG. 3) is pivotably connected to the front end portion of the revolving arm 124 via a pin member (not shown). Accordingly, the cover member 102 is mounted on the unit frame 20 for free movement between an open position shown in FIGS. 1 to 3 and a covering position shown in FIGS. 4 and 5. In relation to the cover member 102, a biasing means and a stop piece 128 (FIG. 2) are provided. The illustrated biasing means is comprised of a torsion coil spring 130 fitted over a boss portion 112*a* provided in the oscillating arm 112. One end of the torsion coil spring 130 engages an engaging portion 132 provided in the outside surface (front surface) of the front wall 104 of the unit frame 120, and its other end engages the oscillating arm 112. The torsion coil spring 130 biases the oscillating arm 112 clockwise in FIGS. 2 and 3, and therefore, the cover member 102 towards the covering position. The stop piece 128 is provided at a predetermined site of the outside surface of the front wall 104 in the unit frame 20. It acts on the oscillating arm 112 to hamper the clockwise pivoting of the oscillating arm 112 in FIGS. 2 and 3, namely the movement of the cover member 102 beyond the covering position. In the embodiment described above, the biasing means and the stop piece 128 are provided correspondingly to oscillating arm 112. If desired, they may be provided correspondingly to the other oscillating arm 114 or to both the oscillating arms 112 and 114.

An actuating protrusion 134 capable of acting on the actuating lever 122 in the process unit 14 is provided. In the illustrated embodiment, the actuating protrusion 134 is provided on the upper surface of the front portion of the bottom wall of the lower supporting frame 4 and projects upwardly in an elongate wedge shape. The actuating lever 122 may, as required, be provided at the rearwardly projecting end portion of the shaft member 118, in which case the actuating protrusion 134 is provided on the upper surface of the rear portion of the bottom wall in the lower supporting frame 4. Hence, when the upper supporting frame 6 is pivoted in a direction shown by an arrow 136 (FIGS. 4 and 5) toward the closed position from the open position, the free end portion of the actuating protrusion 134 contacts the actuating lever 122 and revolves it in a direction shown by an arrow 138 (FIG. 5; counterclockwise in FIG. 5). As a result, the revolving arms 120 and 124 are revolved in the direction of arrow 138 as a unit with the shaft member 118.

In the illustrated embodiment, a plurality of longitudinally spaced guide ribs 140 (mainly FIGS. 1 and 3) are provided on the outside surface of one side portion of the cover member 102 (that surface which is opposite to the surface facing the peripheral surface of the rotating drum 26). In the illustrated embodiment, these guide ribs 140 are formed as a unit with the cover member 102.

Figure 4:
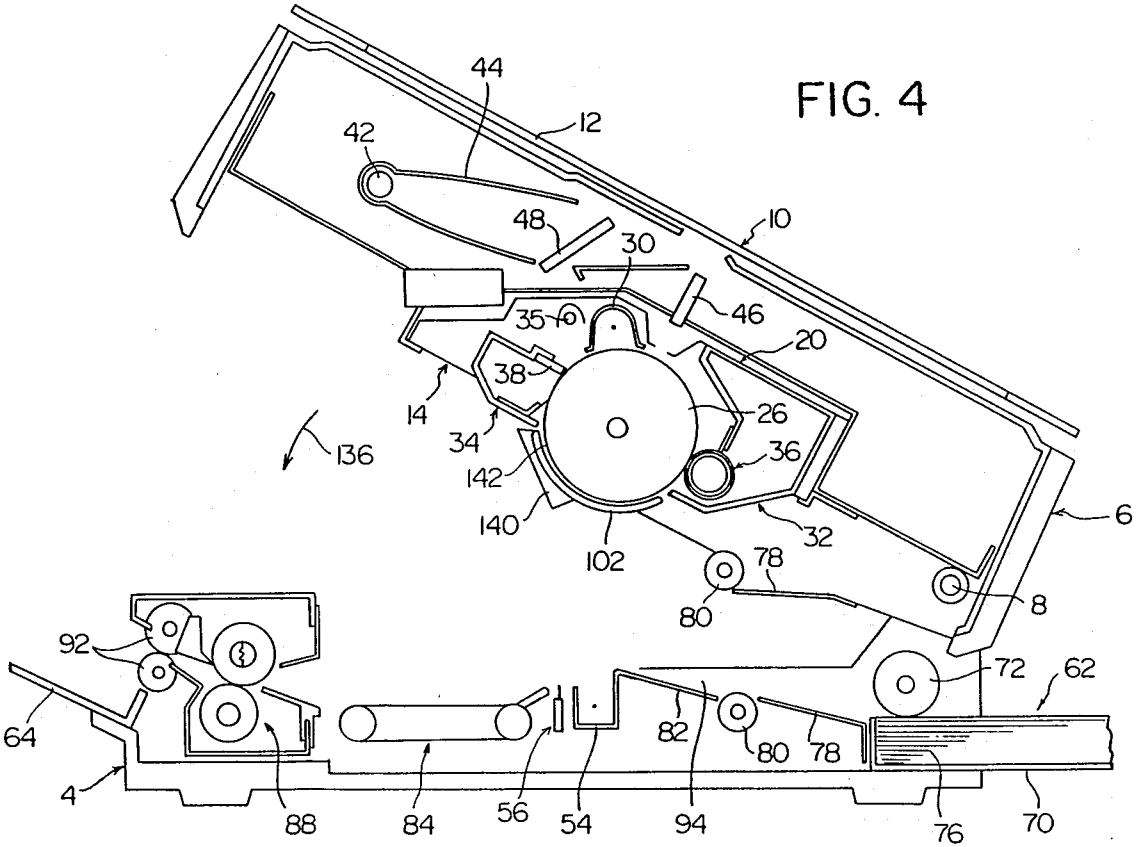
FIG. 4 is a sectional view showing in a simplified manner an upper supporting frame as it is at the open position in the electrostatic copying machine of FIG. 1.
Figure 5:
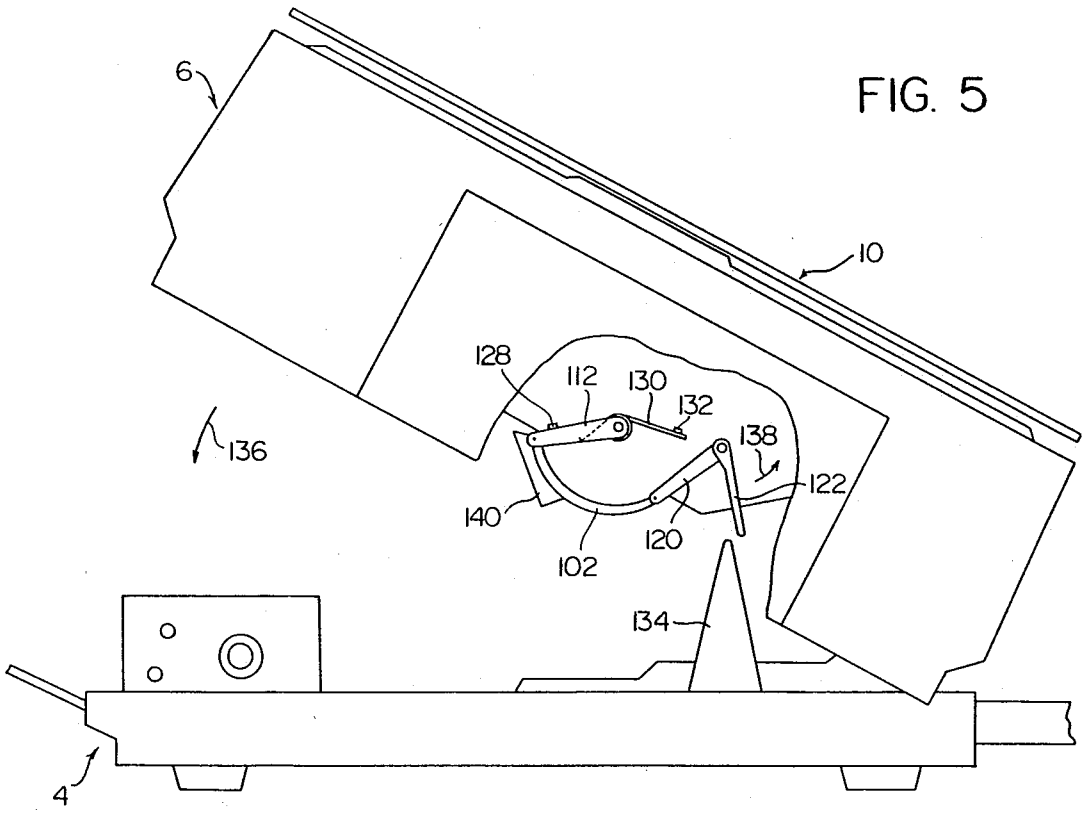
FIG. 5 is a side elevation, partly broken away, of the state shown in FIG. 4.

When in the electrostatic copying machine of the above structure, the upper supporting frame 6 is pivoted to the open position, the open condition shown in FIGS. 4 and 5 is created. Specifically, when the upper supporting frame 6 is held at the open position, the actuating lever 122 moves away from the actuating protrusion 134 of the lower supporting frame 4. As a result, the oscillating arm 112 is biased clockwise in FIG. 5 by the action of the torsion coil spring 130, and with it, the revolving arms 120 and 124 are revolved clockwise in FIG. 5 via the cover member 102. Hence, the cover member 102 is held at the covering position shown in FIGS. 4 and 5. When the cover member 102 is held at the covering position, the oscillating arm 112 contacts the stop piece 128 provided in the front wall 104 of the unit frame 20, whereby the movement of the cover member 102 beyond the covering position can be hampered accurately. It will be readily understood from FIG. 4 that when the cover member 102 is held at the covering position, the cover member 102 is located below the rotating drum 26 to cover a transfer opening 142 defined in the unit frame 20, and therefore, the lower portion of the rotating drum 26 which is exposed through the transfer opening 142 (and further through the opening formed in the under surface of the upper supporting frame 6) is substantially covered with the cover member 102. Furthermore, in the aforesaid open condition, a greater portion of the paper conveying passage 94 is open to view and paper which has jammed up can be easily removed from it. Since the lower portion of the rotating drum 26 is covered with the cover member 102, the operator's hand or the like can be accurately prevented from touching the surface of the photographic material on the rotating drum 26 during the removal of the jamming paper.

Figure 2:
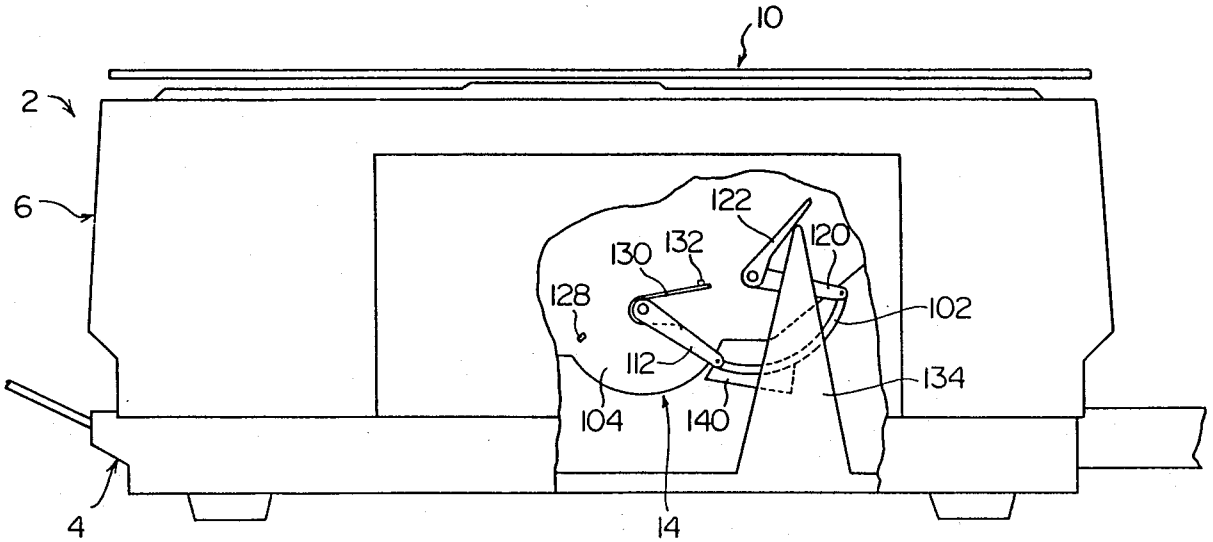
FIG. 2 is a side elevation, partly broken away, of the electrostatic copying machine of FIG. 1.
Figure 3:
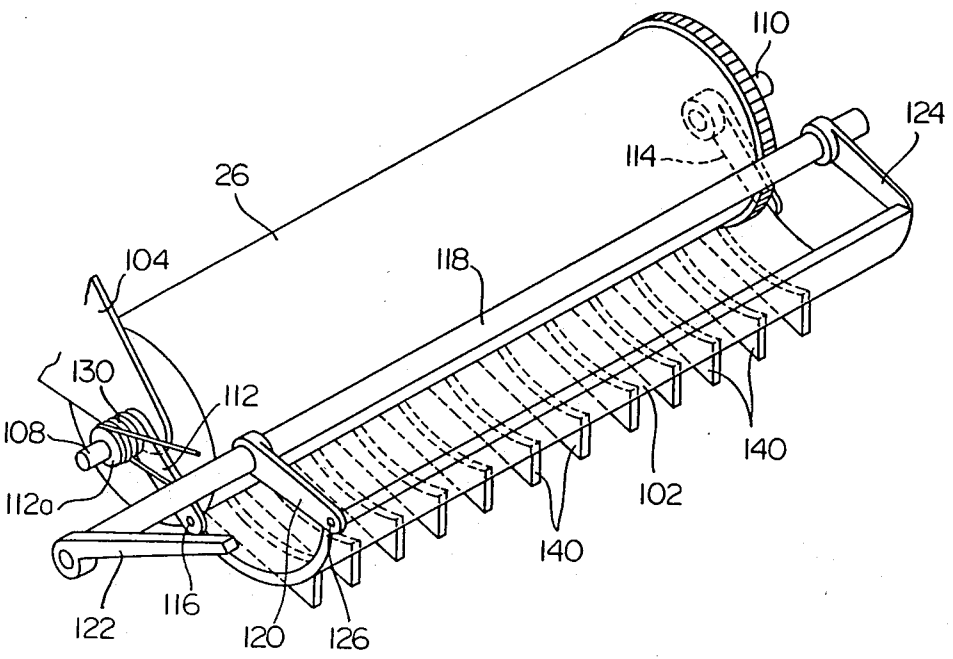
FIG. 3 is a perspective view showing a cover member and elements related thereto in the electrostatic copying machine of FIG. 1.

When the upper supporting frame 6 is pivoted in the direction of arrow 136 (FIGS. 4 and 5) and held at the closed position, the open condition shown in FIGS. 1 to 3 is created. When the upper supporting frame 6 is pivoted toward the closed position, the actuating lever 122 contacts the front end of the actuating protrusion 134, and with the pivoting of the upper supporting frame 6 as described above, the actuating lever 122 is pivoted counterclockwise in FIGS. 2 and 3 by the action of the actuating protrusion 134. As a result, the revolving arms 120 and 124 are revolved counterclockwise as a unit with the shaft member 118, and the cover member 102 is moved backward against the biasing action of the torsion coil spring 130 in a direction substantially opposite to the rotating direction of the rotating drum 26 shown by the arrow 28 (FIG. 1), or in other words, toward the developing device 32. When the upper supporting frame 6 is brought to the closed position (held at the closed position by a releasable locking means), the cover member 102 is held at the open position by the action of the actuating protrusion 134 and the actuating lever 122. As shown in FIG. 1, the cover member 102 is moved from the nearly central part to the right part of the process unit 14, more specifically, downward of the developing device 32 from below the rotating drum 26. As a result, the transfer opening 142 defined in the unit frame 20 is open to view, and the lower portion of the rotating drum 26 is exposed through the transfer opening 142. Copying paper conveyed through the paper conveying passage 94 comes, into intimate contact with the surface of the electrophotographic material on the rotating drum 26 in the transfer zone 52. When the cover member 102 is at the open position, its one side portion is positioned above the guide plate 82 and the guide ribs 140 provided in the cover member 102 project downwardly, as clearly depicted in FIG. 1. Accordingly, the under surfaces of the guide ribs 140 define the upper side of part of the paper conveying passage 94, and the paper conveyed by the pair of conveying rollers 80 is conducted to the transfer zone 52 via a space between the guide plate 82 and the guide ribs 140.

In the above electrostatic copying machine, the cover member 102 is moved in a direction substantially opposite to the rotating direction of the rotating drum 26 and held at the open position. This brings about the following advantage. If the cover member, as in the prior art, is moved in the rotating direction of the rotating drum and held at the open position, the lower portion of the rotating drum is exposed starting with the upstream side of the rotating direction. Hence, in the event the paper wraps about the rotating drum, it is relatively difficult to remove the wrapping paper. In contrast, in the electrostatic copying machine in accordance with this invention, the cover member 102 moves in a direction opposite to the rotating direction of the rotating drum 26, and the lower portion of the rotating drum 26 is exposed beginning with the downstream side of the rotating direction shown by arrow 28. This structure enables the wrapping paper to be easily removed from the rotating drum 26. Furthermore, during movement of the cover member 102 toward the covering position, the cover member 102 acts in a manner to get into a space between the rotating drum 26 and the paper wrapping about it. This also makes it easy to remove the wrapping paper. Moreover, in the illustrated embodiment, the guide ribs 140 provided on the under surface of the cover member 102 also act in a manner to get into the space between the rotating drum 26 and the paper wrapping about it. This further makes it easy to remove the wrapping paper.

In the electrostatic copying machine described above, cover member 102 is held at the covering position when the actuating lever 122 moves away from the actuating protrusion 134. Accordingly, when the process unit 14 is detached from the upper supporting frame 6, the cover member 102 is held at the covering position. Consequently, the lower portion of the rotating drum 26 is covered with the cover member 102 even during storage of the process unit 14, and is never exposed.

Improvements in the Electrostatic Copying Machine in the First Embodiment

Figure 6:
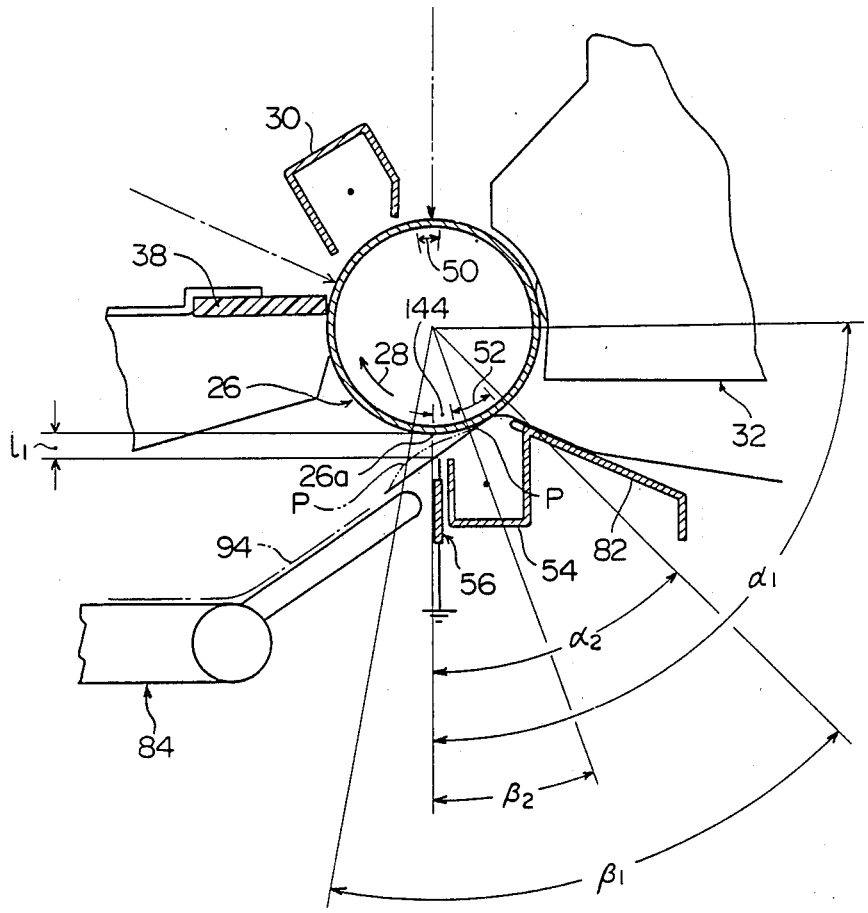
FIG. 6 is a simplified sectional view showing on an enlarged scale part of a modified embodiment resulting from improving part of the electrostatic copying machine shown in FIG. 1.

When a small-diameter rotating drum having a diameter of, for example, about 30 mm is used as the image bearing member in the first embodiment of the electrostatic copying machine shown in FIGS. 1 to 5, it is preferred to arrange the transfer zone and the peeling zone as shown in FIG. 6.

In FIG. 6 to 9, members which are substantially the same as those shown in FIGS. 1 to 5 will be designated by the same reference numerals as shown in FIGS. 1 to 5.

Figure 8:
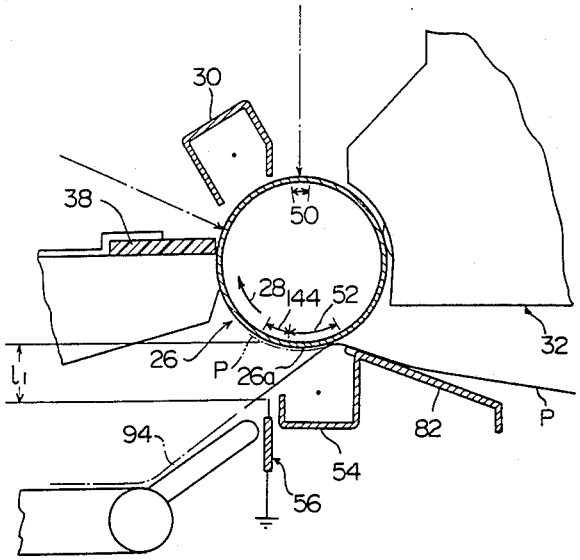
FIG. 8 is a simplified sectional view showing one example of a conventional image-forming machine.

By comparison of FIG. 6 showing the rotating drum and its vicinity in the improved electrostatic copying machine with FIG. 8 showing a rotating drum and its vicinity in the conventional electrostatic copying machine, it is appreciated that the following improvements are made in the electrostatic copying machine shown in FIG. 6.

Firstly, the transfer zone 52 in which the transfer corona discharge device 54 is positioned apart from, and opposite to, the peripheral surface of the rotating drum 26 is displaced in a direction opposite to the rotating direction of the rotating drum 26 as compared with the case of the conventional copying machine. It is critical that the transfer zone 52 should be arranged in a region within an angle of −90 to 0 degree (the region shown by the symbol $\alpha_1$ in FIG. 1), preferably −45 to 0 degree (the region shown by the symbol $\alpha_2$ in FIG. 1), from the lowermost site 26*a* of the rotating drum 26 as viewed in the rotating direction of the rotating drum 26.

Secondly, in addition to the aforesaid displacement of the transfer zone 52, the peeling zone 144 in which the charge eliminating means 56 is positioned apart from the peripheral surface of the rotating drum 26 is also displaced in a direction opposite to the rotating direction of the rotating drum 26 as compared with the case of the conventional electrostatic copying machine. It is critical that the peeling zone 144 should be arranged in a region within an angle of −45 to 10 degree (the region shown by the symbol $\beta_1$ in FIG. 1), preferably −20 to 0 degree (the region shown by the symbol $\beta_2$ in FIG. 1), from the lowermost site 26*a* of the rotating drum as viewed in the rotating direction of the rotating drum 26.

The charge eliminating means 56 may be made of a suitable electrically conductive material, such as a needle-like material having a number of needle-like elements at its upper end or a material having a saw-toothed upper end, which is grounded directly or via a suitable bias power supply (not shown).

With regards to the angular ranges $\alpha_1$, $\alpha_2$, $\beta_1$ and $\beta_2$, the following geometric analysis should be noted. Within the angular range of −90 to 0 degree from the lowermost site 26*a* of the rotating drum 26 as viewed in the rotating direction of the drum, the peripheral surface of the rotating drum 26 descends as the rotating drum 26 progresses in the rotating direction because the peripheral surface of the rotating drum 26 is circular. The degree of descending with respect to the progression of the drum in the rotating direction decreases as the drum progresses in the rotating direction (and therefore as the angle approaches zero). On the other hand, within the angular range of 0 to 90 degrees from the lowermost site 26*a* of the rotating drum 26 as viewed in the rotating direction of the rotating drum 26, the peripheral surface of the rotating drum 26 rises as the rotating drum 26 progresses in the rotating direction. The degree of rising with respect to the progression of the drum in the rotating direction increases as the drum progresses in the rotating direction (and therefore, as the angle increases). Accordingly, if the transfer zone 52 and the peeling zone 144 are arranged within the regions mentioned above, the distance $l_1$ between the peripheral surface of the rotating drum 26 and the upper end of the charge eliminating means 56 in the peeling zone 144 can be drastically decreased as compared with the conventional copying machine even when the downward inclination of the conveying passage 94 for the copying paper P advancing downstream from the peripheral surface of the rotating drum 26 at the circumferentially central site of the transfer zone 52 is prescribed at substantially the same inclination as in the conventional copying machine. Thus, it is possible to position the charge eliminating means 56 below the conveying passage 94 for the copying paper P advancing downstream from the transfer zone 52 so as to project upwardly and shut up the conveying passage 94, and consequently, to decrease the above distance $l_1$ as desired without the need for changing the conveying passage 94. Desirably, the distance $l_1$ is generally not more than 7 mm, especially not more than 5 mm.

Preferably, the transfer corona discharge device 54 and the charge eliminating means 56 are mounted such that the charge eliminating means 56 is positioned as is required with respect to the transfer corona discharge device 54 and the transfer corona discharge device 54 is positioned as is required with respect to the rotting drum 26.

In the electrostatic copying machine shown in FIG. 6 which is improved as described above, the copying paper P in intimate contact with the peripheral surface of the rotating drum 26 in the transfer zone 52, if it has relatively high stiffness, departs downwardly from the peripheral surface of the rotating drum 26 by its own stiffness and weight as it advances downstream. In addition, the charge on it is fully eliminated by the action of the charge eliminating means 56. Hence, the copying paper P is surely separated from the peripheral surface of the rotating drum 26, and conveyed through the conveying passage 94. If the copying paper P has low stiffness or a propensity to curl upwardly towards its front end, it tends to advance while electrostatically adhering to the peripheral surface of the rotating drum 26 even in the peeling zone 144, as shown by the two-dot chain line in FIG. 6. However, since the upper end of the charge eliminating means 56 is positioned in proximity to the back surface of the copying paper P in the peeling zone 144, the charge on the paper P is fully and accurately eliminated by the action of the charge eliminating means 56. Consequently, the copying paper P is surely separated from the peripheral surface of the rotating drum 26 and conveyed through the conveying passage 94.

In the conventional electrostatic copying machine shown in FIG. 8, the copying paper P separated from the rotating drum 26 is adapted to be conveyed through the conveying passage 94 which extends at substantially the same level as the lowermost site 26*a* of the rotating drum 26 or below the lowermost site 26*a* (in FIG. 8, it extends inclinedly downwardly to the left and then substantially horizontally to the left). Accordingly, if the copying paper P has relatively high stiffness, it departs downwardly from the peripheral surface of the rotating drum 26 by its own stiffness and weight as it advances downwardly as shown by the solid line in FIG. 8. In addition, the charge on it is fully eliminated by the action of the charge eliminating means 56, and the paper P is surely separated from the peripheral surface of the rotating drum 26 and conveyed properly. If, however, the copying paper P has low stiffness or a propensity to curl upwardly toward its front end, it tends to advance while electrostatically adhering to the peripheral surface of the rotating drum 26 without departing downwardly from it, as shown by the two-dot chain line in FIG. 8. Since at this time, there is considerable distance between the back surface of the copying paper P and the upper end of the charge eliminating means 56, the charge on the paper P cannot fully be eliminated by the action of the charge eliminating means 56. This leads to a situation in which the paper P wraps about the rotating drum 26 without separating from its peripheral surface.

Figure 9:
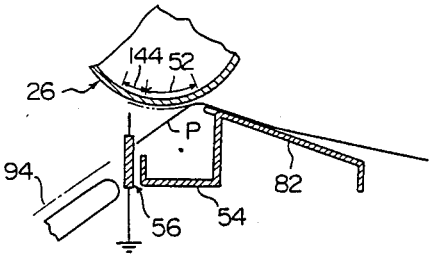
FIG. 9 is a simplified sectional view showing a modified example of part of the image-forming machine shown in FIG. 8.

This problem could be solved by moving the charge eliminating means 56 upwardly and make its upper end approach the peripheral surface of the rotating drum 26, as shown in FIG. 9. By doing so, the upper end of the charge eliminating means 56 approaches the back surface of the copying paper P advancing while adhering to the peripheral surface of the rotating drum 26, and the charge on the paper P is fully eliminated by the action of the charge eliminating means 56. As a result, the paper P can be separated from the peripheral surface of the rotating drum 26. However, when the charge eliminating means 56 is moved upwardly as shown in FIG. 9, it extends upwardly while shutting up the conveying passage 94 for the paper P. Hence, the paper P which has relatively high stiffness and therefore departs downwardly from the peripheral surface of the rotating drum 26 and advances through the conveying passage 94 as shown by the solid line in FIG. 9 comes into collision with the charge eliminating means 56 and fails to advance further.

In contrast, in the improved electrostatic copying machine described above, the upper end of the charge eliminating means 56 is positioned in proximity to the back surface of the copying paper P in the peeling zone 144 because the transfer zone 52 is disposed in the region within an angle, $\alpha$, of $-90$ to 0 degree from the lowermost site 26a of the rotating drum 26 as viewed in the rotating direction of the rotating drum 26 and the peeling zone 144 is disposed in the region within an angle, $\beta$, of $-45$ to 10 degrees from the lowermost site 26a of the rotating drum 26 as viewed in the rotating direction of the rotating drum 26. Accordingly, the copying paper P, even if it has low stiffness or a propensity to curl upwardly, can be surely separated from the peripheral surface of the rotating drum 26 in the transfer zone 52 by the action of the charge eliminating means 56 and conveyed properly without entailing inconveniences such as changing of the conveying passage for the paper P.

Figure 7:
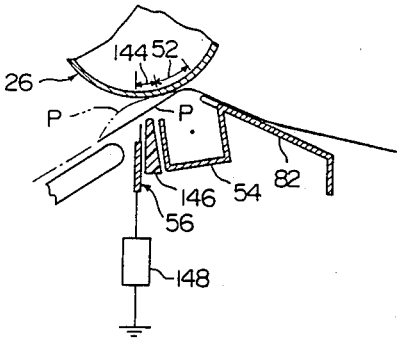
FIG. 7 is a simplified sectional view showing another modified embodiment resulting from further modification of part of the modified embodiment shown in FIG. 6.

If desired, it is possible to place an insulating member of a suitable form between the transfer corona discharge device 54 and the charge eliminating means 56 as shown in FIG. 7, and ground the charge eliminating means 56 via a suitable bias power supply 148 instead of grounding it directly. Furthermore, a known guide line (not shown) extending inclinedly in the paper conveying direction may be disposed in the opening of a shield case for the transfer corona discharge device 54 in order to prevent advancing of the copying paper P into the shield case and the consequent obstruction of its progress.

Electrostatic Copying Machine of Second Embodiment

Now, with reference to FIGS. 10 to 13, a second embodiment of the electrostatic copying machine as one example of the image-forming machine in accordance with this invention will be described in detail.

Figure 10:
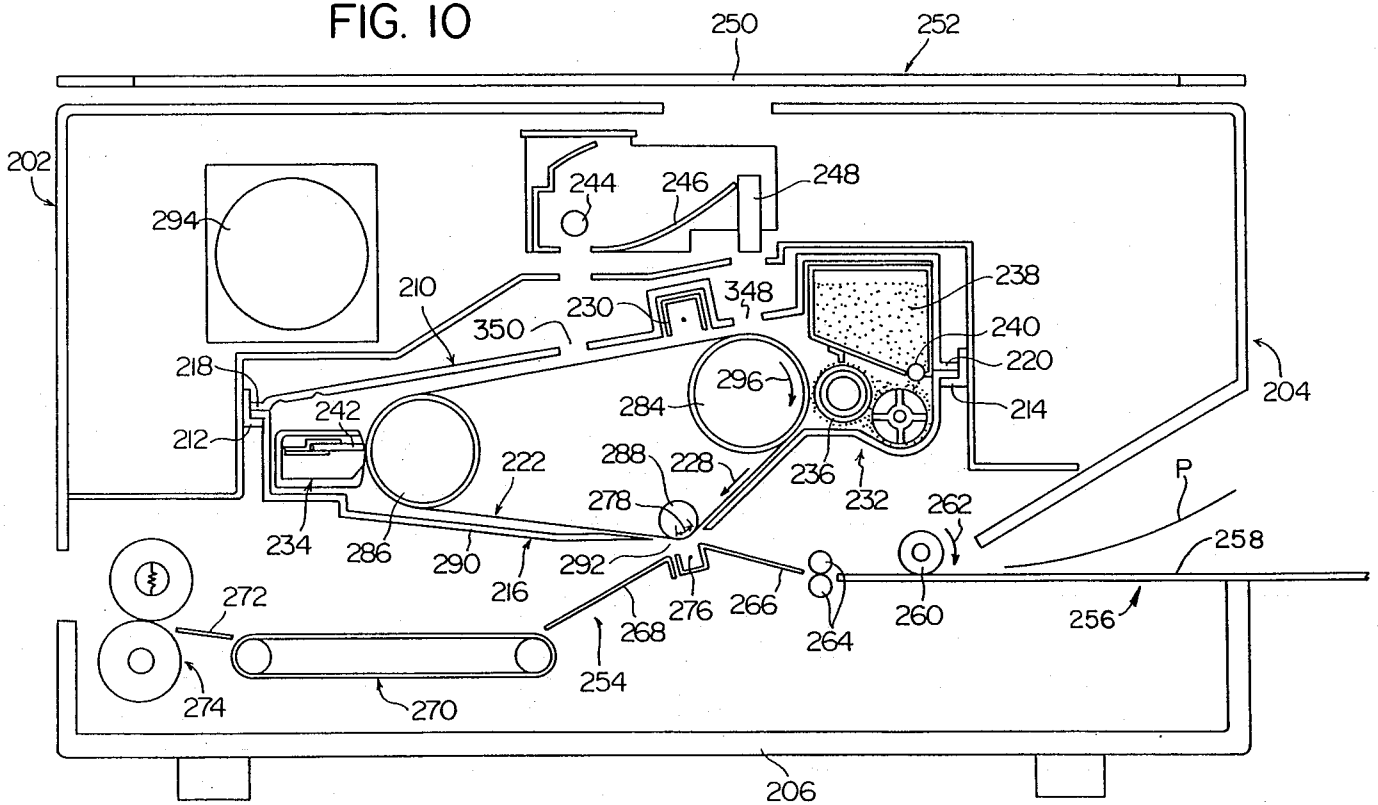
FIG. 10 is a simplified sectional view showing a second embodiment of the electrostatic copying machine as one example of the image-forming machine constructed in accordance with this invention.
Figure 11:
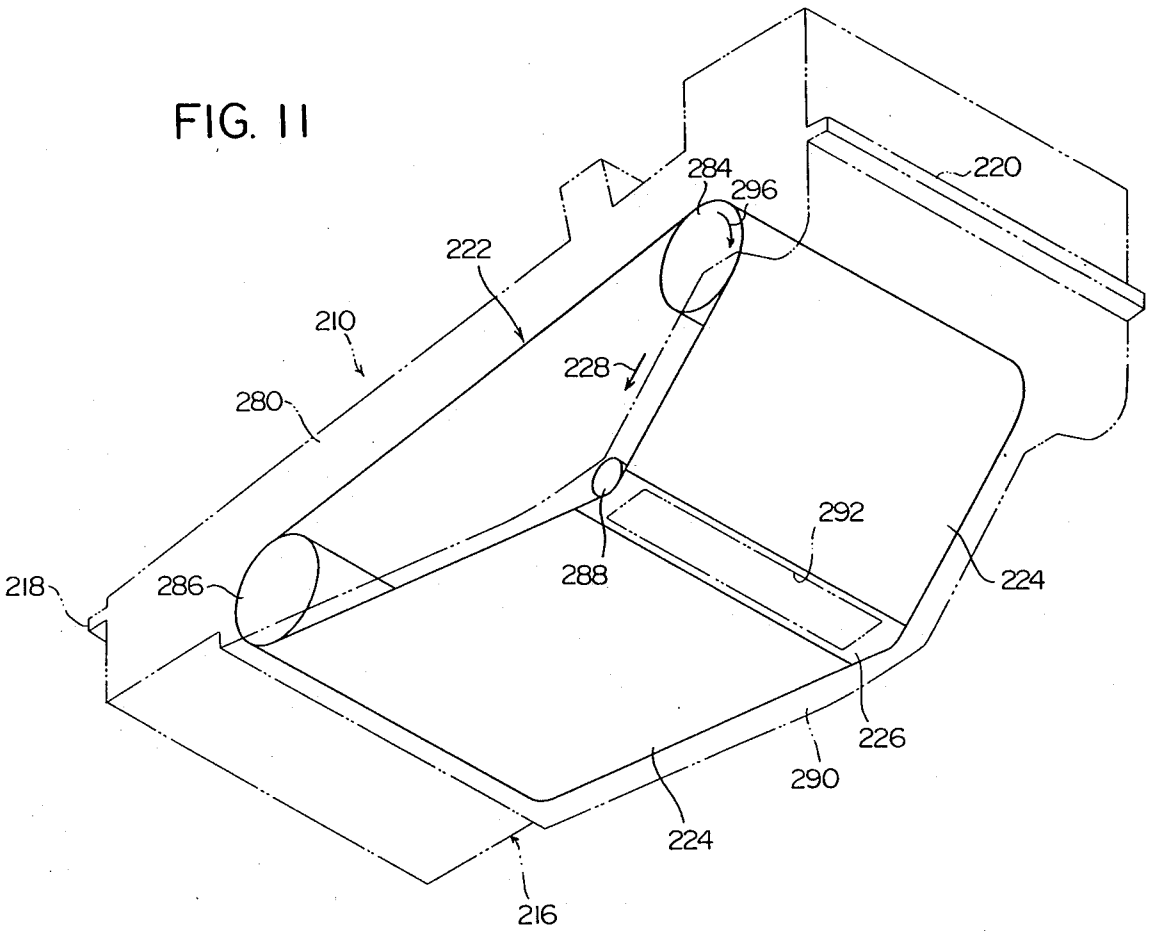
FIG. 11 is a simplified perspective view showing the relation between a process unit frame and an image bearing member in a process unit provided in the electrostatic copying machine shown in FIG. 10.

With reference to FIG. 10, the illustrated electrostatic copying machine includes a main body 204 of copying machine comprising a nearly parallelepipedal housing 202. The main body 204 has a bottom wall 206 defining the bottom surface of the housing 202 and a vertical front base plate (not shown) and a vertical rear base plate 208 (FIG. 13) spaced from each other in the front-rear direction (a direction perpendicular to the sheet surface in FIG. 10) and extending upwardly from the bottom wall 206. Various constituent elements (to be described hereinafter) are mounted in place between the vertical front base plate and the vertical rear base plate 208. A process unit 210 is detachably mounted nearly centrally on the main body 204. In the second embodiment, a pair of supporting rails 212 and 214 spaced from each other in the left-right direction and extending in a direction perpendicular to the sheet surface are fixed to the main body 204. The process unit 210 has a box-like process unit frame 216, and support portions 218 and 220 extending in a direction perpendicular to the sheet surface are provided in the left side wall and right side wall of the process unit frame 216. Accordingly, in the second embodiment, too, the process unit 210 is mounted and detached by positioning the support portions 218 and 220 of the unit frame 216 on the supporting rails 212 and 214 and sliding the unit frame 216 in a direction perpendicular to the sheet surface. An endless belt 222 acting as an image bearing member is mounted on the unit frame 216. An image-forming area 224 on which to form an image is formed in a greater portion of the surface of the endless belt 222 as shown in FIG. 11, and a non-image-forming area 226 on which substantially no image is formed is disposed in the remainder of the belt 222. In the illustrated embodiment, a electrophotographic material is disposed in the image-forming area 224, and an image is formed on the electrophotographic material. On the other hand, substantially no electrophotographic material exists in the non-image-forming area 226, and an image is not formed on the non-image-forming area 226. It is possible alternatively to dispose an endless electrophotographic material on the entire peripheral surface of the endless belt 222 and to utilize a specific region occupying a greater part or the electrophotographic image-forming area 224 and the remainder as the non-image-forming area 226. The endless belt 222 is moved in the direction shown by an arrow 228. The length of the image-forming area 224 on the endless belt 222 in the moving direction of arrow 228 is substantially equal to, or slightly larger than, the maximum copyable length of the document. Also mounted on the unit frame 216 are a charging corona discharge device 230, a developing device 232, and a cleaning device 234 around the endless belt 222 to be moved in the direction of arrow 228 in the order stated as viewed in the moving direction. The developing device 232 has a magnetic brush mechanism 236 for applying a toner to the image-forming area 224 on the endless belt 222, a toner receptacle 238 for holding a toner and a feed roller 240 for feeding the toner from the toner receptacle 238. The cleaning device 234 has an elastic blade 242 adapted to act on the surface of the endless belt 222. The process unit 210 will be more specifically described hereinbelow.

An illuminating lamp 244, a reflecting plate 246 and an optical system 248 are further mounted on the upper part of the main body 204 of the copying machine. A document placing means 252 provided with a transparent plate 250 which can reciprocate is mounted on the upper surface of the housing 202.

A copying paper conveying system 254 is disposed in the lower part of the main body 204 of the copying machine. A copying paper feed means 256 is provided at the upstream end of the paper conveying system 254, and a copying paper receiving tray (not shown) is disposed at its downstream end. The paper feed means 256 has a guide table 258 extending to the right from inside the housing 202 and a feed roller 260 disposed above the guide table 258. A copying paper P is fed downstream along the guide table 258 by revolving the feed roller 260 in the direction shown by an arrow 262. The paper conveying means 254 has a pair of conveying rollers 264, a guide plate 266, a guide plate 268, a conveying belt mechanism 270, a guide plate 272 and a fixing roller pair 274. The paper conveying means 254 conveys the paper P fed by the action of the paper feed means 256 to the paper receiving tray (not shown) through a transfer zone 278 existing between a transferring corona discharge device 276 and the endless belt 222.

A detailed description of the operation of the electrostatic copying machine in accordance with the second embodiment is omitted herein because it is substantially the same as that of the first embodiment shown in FIGS. 1 to 5.

Now, the process unit 210 will be described with reference to FIGS. 10 and 11. The unit frame 216 of the process unit 210 has a front wall 280 (FIG. 11) and a rear wall 282 (FIGS. 12-A and 13) disposed in spaced-apart relationship in the front-rear direction. Between the front wall 280 and the rear wall 282 are rotatably mounted three rollers 284, 286 and 288 (rollers 284 and 286 of a relatively large diameter and roller 288 of a relatively small diameter). The roller 284 is provided in the right end portion of the unit frame 216. The roller 286 is provided in the left end portion of the unit frame 216. The roller 288 is disposed correspondingly to a transfer opening 292 formed in a bottom wall 290 of the unit frame 216. The endless belt 222 is wrapped around these rollers 284, 286 and 288. In the illustrated embodiment, the roller 284 is drivingly connected to driving source 294 (FIG. 10) for the electrostatic copying machine as will be described hereinbelow. Hence, when the driving source 294 is energized and the roller 284 is rotated in the direction shown by an arrow 296, the endless belt 222 is moved in the direction shown by arrow 228. Preferably, in relation to the transfer opening 292 formed in the unit frame 216, the length of the non-image-forming area 226 provided in the endless belt 222 in the moving direction shown by arrow 228 is set so as to be slightly larger than the width W (FIG. 11) of the transfer opening 292. This makes it possible to prevent accurately injuring of the electrophotographic material through the transfer opening.

The second embodiment is so constructed that when the copying step for image formation is over, the non-image-forming area of the endless belt 222 is positioned at the transfer opening 292 formed in the unit frame 216 (more specifically, at that site at which it is exposed through the transfer opening 292). With reference to FIGS. 12-A and 12-B, the process unit 210 has provided therein a detecting means 298 for detecting the position of the endless belt 222. The position detecting means 298 in the illustrated embodiment is constructed of a combination of a detection hole 300 (see FIG. 12-B also) provided at a given site in the endless belt 222 and an optical detecting means 302 mounted on the rear wall 282 of the process unit 216. The optical detecting means 302 has a light emitting element 304 disposed on one side of (above) the endless belt 222 and a light receiving element 306 disposed on the other side of (below) the belt 222. When the endless belt 222 is at a specific position (at which the belt 222 is in the state shown in FIG. 11 and its non-image-forming area 226 is positioned at the transfer opening 292 of the unit frame 216), the detection hole 300 formed in the belt 222 is positioned between the light emitting element 304 and the light receiving element 306 as shown in FIG. 12-A. Hence, the light from the light emitting element 304 is received by the light receiving element 306.

The detection signal of the optical detecting means 302 is fed to a control means 308. A main power supply switch 310 is provided in the main body 204 of the copying machine, and a copying switch 312 is provided in its operating panel (not shown). Signals from the main power supply switch 310 and the copying switch 312 are also fed to the control means 308. The control means 308 actuates and controls the driving source 294 and an electromagnetic solenoid 314 on the basis of the signal fed from the optical detecting means 302, the main power supply switch 310 and the copying switch 312.

In the illustrated embodiment, the roller 284 is drivingly connected to the driving source 294 via a driving system shown in FIG. 13. Specifically, shaft portions 316 (one of which is shown) are provided at opposite ends of the roller 284 and supported rotatably on the front wall 280 and the rear wall 282 of the unit frame 216 via bearing members. An auxiliary plate 318 is attached to the vertical rear base plate 208, and a shaft member 320 is rotatably supported via a bearing member between the vertical rear base plate 208 and the auxiliary plate 318. The shaft member 320 is drivingly connected to the shaft member 316 at the rear end of the roller 284 via a releasable connecting means 322. The connecting means 322 has a concave coupling 324 mounted on one end of the shaft member 320 and a convex coupling 326 mounted on the shaft portion of the roller 284. Annexed to the concave coupling 324 is a biasing spring 328 for biasing the convex coupling 324 toward the convex coupling 326. Accordingly, when the process unit 210 is mounted on the main body 204 of the copying machine in the manner described hereinabove, the convex coupling 326 and the concave coupling 324 engage each other as shown in FIG. 13. As a result, the roller 284 is connected to the shaft member 320 via the connecting means 322. On the other hand, when the process unit 210 is drawn away from the sheet surface in FIG. 10, the couplings 326 and 324 are disengaged from each other, and the roller 284 is disconnected from the shaft member 320.

The shaft member 320 has mounted thereon a clutch means for selectively transmitting the driving force from the driving source 294. In the illustrated embodiment, the clutch means is constructed of a spring clutch means 330 known per se. The spring clutch means 330 has a first boss 334 provided as a unit in a gear 332, a second boss 338 fixed to the shaft member 320 by a screw 336, a coil spring 340 provided astride the first and second bosses 334 and 338, and a sleeve 342 fitted over the coil spring 340. The electromagnetic solenoid 314 for hampering rotation of the sleeve member 342 is provided therein. The gear 332 is rotatably mounted on the shaft member 320, and is in mesh with a gear 344 drivingly connected to the driving source 294 (FIG. 10). Because of the above structure, when the electromagnetic solenoid 314 is in the deenergized state, the rotation of the sleeve member 342 is hampered by the action of its output portion. Consequently, the coil spring 340 does not contract nor the first and second bosses 334 and 340 are connected drivingly via the coil spring 338. Thus, the shaft member 320 does not rotate with the rotation of the gear 332. On the other hand, when the electromagnetic solenoid 314 is energized, its output portion moves away from the sleeve member 342 to permit rotation of the sleeve 342. As a result, the rotation of the gear 332 permits contraction of the coil spring 340 to drivingly connect the first and second bosses 334 and 338 via the coil spring 340. Thus, with the rotation of the gear 332, the shaft member 320 and the roller 284 are rotated in the direction of arrow 296.

The controlling of the electrostatic copying machine in the second embodiment will be described with reference to FIGS. 10, 12-A and 13.

When the main power supply switch 310 is turned on to start the machine the control means 308 energizes the main driving source 294. The action of the main driving source causes rotation of the conveying rollers 264, the conveying belt mechanism 270, etc. in the paper conveying system 254 as well as the gears 344 and 332. At this time, the electromagnetic solenoid 314 is deenergized, and the driving force of the gear 332 is not transmitted to the shaft member 320 and the roller 284. Hence, the endless belt 222 is at a stop.

When the copying switch 312 is then turned on, the control means 308 energizes the electromagnetic solenoid 314 to permit rotation of the sleeve member 342 in the spring clutch means 330. The coil spring 340 thus contracts to connect the gear 332 and the shaft member 320 drivingly via the spring clutch means 330. The driving force from the driving source 294 is transmitted to the roller 284 via the gear 332, the spring clutch means 330, the shaft member 320 and the connecting means 322. The roller 284 is consequently rotated in the direction of arrow 296, and the endless belt 222 is moved in the direction of arrow 228. During this movement of the endless belt 222, a toner image corresponding to the document is formed in the image-forming area 224 of the belt 222, and transferred to copying paper P in the transfer zone 278.

The illustrated embodiment is constructed such that when the endless belt 222 rotates through three turns from the start of movement (when the image-forming area 224 is completely cleaned as can be understood from FIG. 10), the electromagnetic solenoid 314 is deenergized. Every time the endless belt 222 rotates once, the detection hole 300 provided in the belt 222 passes between the light emitting element 304 and the light receiving element 306 of the optical detecting means 302. During this passage, the light from the light emitting element 304 is received by the light receiving element 306 through the detection hole 300, and the optical detecting means 302 produces a detection signal. When the optical detecting means 302 detects the detection hole 300 three times, the control means 308 deenergizes the electromagnetic solenoid 314 on the basis of the detection signal in the third pulse from the detecting means 302. As a result, the output portion of the electromagnetic solenoid 314 acts on the sleeve member 342 of the spring clutch means 330 to hamper its rotation. Thus, the driving connection between the gear 332 and the shaft member 320 via the spring clutch means 330 is released, and the movement of the belt 222 in the direction of arrow 228 is stopped.

When thereafter the main power supply switch 310 is turned off, the main driving source 294 is deenergized to stop the rotation of the gear 332 and the conveying rollers 264 in the paper conveying system 254.

This electrostatic copying machine has the following noteworthy characteristic features. When the endless belt 222 is held at the specific position shown in FIG. 11, the electromagnetic solenoid 314 is deenergized to stop the movement of the endless belt 222 in the direction of arrow 228. It will be easily seen therefore that after the movement of the endless belt 222 has stopped and the copying cycle for image formation has ended, the endless belt 222 is held at the aforesaid specific position and the non-image-forming area 226 formed in the endless belt 222 is positioned at the transfer opening 292. Hence, in the event that the hand of the operator should inadvertently touch the surface of the endless belt 222 through the transfer opening 292, it only makes contact with the non-image-forming area 226 of the belt 222 and not with the image-forming area 224 where the electrophotographic material exists. Injuring of the electrophotographic material can therefore be avoided.

In the second embodiment, the spring clutch means 330 is used to transmit the driving force from the main driving source 294 selectively to the shaft member 320. Alternatively it is possible to apply an ordinary electromagnetic clutch means instead of the spring clutch means 330.

Preferably, an exposure opening 348 and a charge eliminating opening 350 provided in the unit frame 216 are covered by providing a protective glass such as a transparent glass over them in order to prevent more accurately the injuring of the electrophotographic material in the image-forming area 224 of the endless belt 222.

What is claimed is:

1. An image-forming machine comprising:

a main body member and a process unit adapted to be detachably mounted on the main body member;

said process unit including a process unit frame adapted to be mounted on the main body member and an image bearing member mounted on the process unit frame and adapted to be moved in a predetermined direction, said image-bearing member having on the greater portion of the surface thereof an image-forming area on which to form an image, and having on the remainder of the surface thereof a non-image-forming area on which substantially no image is to be formed; and said process unit frame having a transfer opening for passage of a sheet material therethrough to bring the sheet material into intimate contact with the image-forming area of the image bearing member;

said image-bearing member and said process unit frame cooperating so that when an image-forming step is over, the non-image-forming area of the image bearing member is positioned at the transfer opening of the process unit frame.

2. The image-forming machine of claim 1 wherein the image-forming area of the image bearing member has an electrophotographic material thereon, and the non-image forming area of the image bearing member has substantially no electrophotographic material thereon.

3. The image-forming machine of claim 1 further comprising clutch means for releasably transmitting a driving force to the image bearing member; control means for actuating and controlling the clutch means; and position-detecting means for detecting a specific position of the image bearing member means being responsive to a signal from the position-detecting means to deenergize the clutch means when the non-image-forming area of the image bearing member is positioned at the transfer opening of the process unit frame.

4. The image-forming machine of claim 3 wherein when the position-detecting means detect the specific position of the image bearing member, the non-image-forming area of the image bearing member is positioned at the transfer opening of the process unit frame.

5. The image-forming machine of claim 3 wherein the position-detecting means comprises the combination of a detection hole in the image bearing member and optical detecting means disposed on the process unit frame and having a light emitting element and a light receiving element on opposite sides of the detection hole for detection of light passing therethrough.

6. The image-forming machine of claim 1 wherein the image bearing member comprises an endless belt, the image-forming area exists on the greater portion of the surface of the endless belt, the length of the image-forming area in the moving direction thereof being equal to, or slightly larger than, the maximum length of a document of which an image is to be formed.

* * * * *

UNITED STATES PATENT AND TRADEMARK OFFICE

CERTIFICATE OF CORRECTION

PATENT NO. : 4,875,077

DATED : October 17, 1989

INVENTOR(S) : Junichi TAKAMATSU, et al.

It is certified that error appears in the above-identified patent and that said Letters Patent is hereby corrected as shown below:

Column 17, line 9 reads "position of the image bearing member means being" and it should read "position of the image bearing member; the control means being".

Signed and Sealed this

First Day of January, 1991

*Attest:*

HARRY F. MANBECK, JR.

*Attesting Officer*

*Commissioner of Patents and Trademarks*